US011841027B2

(12) United States Patent
Bihler et al.

(10) Patent No.: US 11,841,027 B2
(45) Date of Patent: Dec. 12, 2023

(54) PUMP SYSTEM CONTROL

(71) Applicant: Toshiba International Corporation, Houston, TX (US)

(72) Inventors: Kurt Allen Bihler, Joliet, IL (US); David Liu, Houston, TX (US); Mark Douglas Rayner, Houston, TX (US)

(73) Assignee: Toshiba International Corporation, Houston, TX (US)

( * ) Notice: Subject to any disclaimer, the term of this patent is extended or adjusted under 35 U.S.C. 154(b) by 152 days.

(21) Appl. No.: 17/506,999

(22) Filed: Oct. 21, 2021

(65) Prior Publication Data

US 2022/0163043 A1 May 26, 2022

Related U.S. Application Data

(63) Continuation of application No. 16/299,639, filed on Mar. 12, 2019, now Pat. No. 11,199,194, which is a continuation of application No. 14/240,999, filed as application No. PCT/US2011/049374 on Aug. 26, 2011, now Pat. No. 10,267,324.

(51) Int. Cl.

| | |
|---|---|
| ***F04D 17/10*** | (2006.01) |
| ***F04D 27/00*** | (2006.01) |
| ***F04D 15/00*** | (2006.01) |

(52) U.S. Cl.

CPC ..... *F04D 27/004* (2013.01); *F04D 15/00* (2013.01); *F04D 15/0066* (2013.01); *F04D 17/10* (2013.01)

(58) Field of Classification Search

CPC .... F04D 27/004; F04D 15/00; F04D 15/0066; F04D 17/10

See application file for complete search history.

(56) References Cited

U.S. PATENT DOCUMENTS

| | | | |
|---|---|---|---|
| 4,768,712 | A | 9/1988 | Terrell |
| 6,055,475 | A | 4/2000 | Moriyama |
| 7,534,096 | B2 | 5/2009 | Schulz |
| 2011/0081255 | A1 | 4/2011 | Steger et al. |
| 2015/0016948 | A1 | 1/2015 | Bihler et al. |

FOREIGN PATENT DOCUMENTS

| | | | |
|---|---|---|---|
| WO | 2013032425 | A1 | 3/2013 |

OTHER PUBLICATIONS

Office Action in MX/a/2014/002226 dated Jan. 18, 2016.
International Search Report in PCT/US2011/049374 dated Jan. 31, 2012.
Office Action in Canadian Application No. 2,845,293 dated May 3, 2017.
Jan. 8, 2018—(CA) Office Action—App 2845293.
Apr. 20, 2018—U.S. Non-final Office Action—U.S. Appl. No. 14/240,999.

*Primary Examiner* — David E Sosnowski
*Assistant Examiner* — Maxime M Adjagbe
(74) *Attorney, Agent, or Firm* — Banner & Witcoff, Ltd.

(57) ABSTRACT

A demand-based load balancing function may be provided by one or more drive controllers that takes advantage of the affinity laws to linearize the control of the variable of interest (e.g., flow, pressure, etc.). Each drive controller may be set up by the user simply inputting a few values into the drive controller. Based on the inputs, the drive controllers may interpolate control points using an assumed linear relationship between the variable to be controlled (e.g., pressure) and the current driven to the pump. Feedback data from the system may be used to continually update the drive controllers so as to potentially allow them to better balance power usage to each pump.

20 Claims, 4 Drawing Sheets

PUMP SYSTEM CONTROL

This application is a continuation of U.S. patent application Ser. No. 16/299,639, filed Mar. 12, 2019, which is a continuation of U.S. patent application Ser. No. 14/240,999, filed Sep. 22, 2014 and issued Apr. 23, 2019 as U.S. Pat. No. 10,267,324, which is a national stage filing of PCT/US11/49374, filed Aug. 26, 2011, each of which is hereby incorporated by reference in its entirety for all purposes.

BACKGROUND

Conventional adjustable speed drives (ASDs) are used to control centrifugal pumps in a system, typically by directly controlling the speed at which pumps operate. Often, the pumps are controlled at a speed that is intended to maintain a particular set point of a controlled system variable such as pressure or flow. However, the speed at which a pump operates and the controlled variable in the system usually have a non-linear, and often nearly unpredictable, relationship. Therefore, while the pumps may be controlled so as to maintain the controlled variable, the pumps may be operated at a speed that is more than necessary to achieve such a state. Also, because it is generally unpredictable what speed will correspond to a particular pressure or flow (especially since system conditions may change from time to time), it may take quite a bit of time for the pumps to assume a relatively steady state from startup or after a change in the set point.

This non-linear relationship between the drive output speed value and the controlled variable can make controlling and balancing one or more pumps in a system very complex. Furthermore, the system is typically dynamic and continuously changing depending upon the load, pump differential performance, motor performance, and power delivery performance from the drive controller. Often, a very small change in the speed of one pump may shift the entire load to another pump in the system There have been some known systems implemented by at least one of the inventors listed in the present application in which pumps are controlled by set amount of drive current rather than by set amounts of pump speed. These systems would let the speed attain a natural value base on the set amount of drive current. However, these systems were unable to manage and load balance across multiple pumps in the same system without assuming that each pump would receive the same amount of drive current for a given set point. Moreover, these systems typically controlled the set point from a device separate from the drive controller, thereby preventing the drive controller from adjusting the set point quickly based on system feedback.

SUMMARY

A proposed demand-based load balancing function may be provided by one or more drive controllers that takes advantage of the affinity laws to linearize the control of a variable of interest (e.g., flow, pressure, temperature, fluid level, or any other physical characteristic of the system being controlled). Each drive controller may be set up by the user simply inputting a few values into the drive controller. Based on the inputs, the drive controllers may pray interpolate control points using an assumed linear relationship between the variable to be controlled (e.g., pressure) and the current driven to the pump. Feedback data from the system may be used to continually update the d controllers so as to allow them to potentially better balance power usage to each pump. This may potentially optimize the power requirement of the total system load, and potentially increase the efficiency of the overall control of the system. In some cases, the load balancing function may potentially improve power performance, such as by not necessary running the pump at a higher speed and/or power than needed based on demand.

These and other aspects of the disclosure will be apparent upon consideration of the following detailed description.

BRIEF DESCRIPTION OF THE DRAWINGS

A more complete understanding of the present disclosure and the potential advantages of various aspects described herein may be acquired by referring to the following description in consideration of the accompanying drawings, in which like reference numbers indicate like features, and wherein.

DETAILED DESCRIPTION

Figure 1:
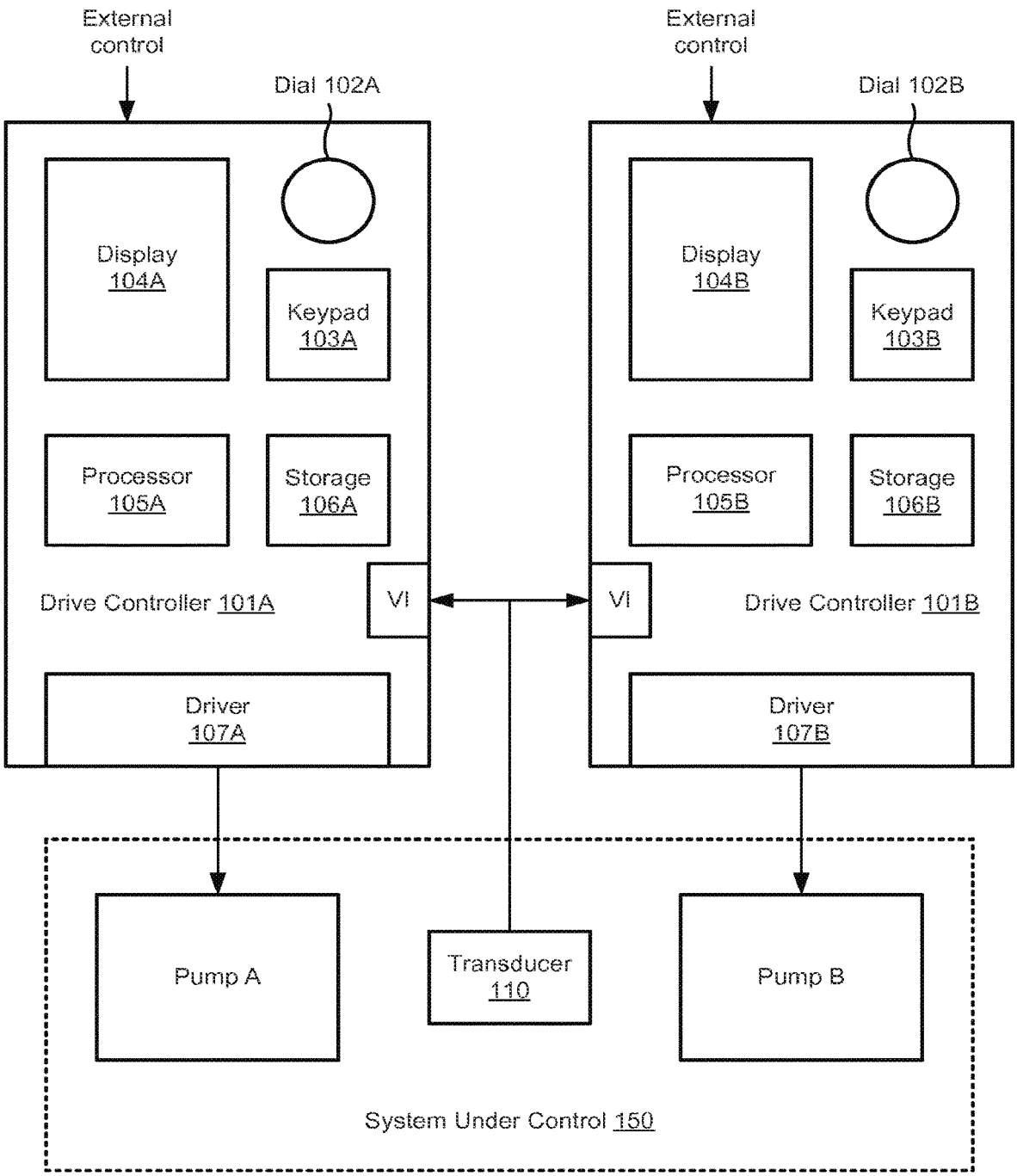
FIG. 1 is a block diagram of an example drive controller system, in accordance with one or more aspects as described herein.

Centrifugal machinery follows a simple set of well-known laws commonly referred to as the affinity laws. The affinity laws state that:

(1) Flow Q is proportional to shaft speed N:

$$\frac{Q_1}{Q_2} = \left(\frac{N_1}{N_2}\right) \quad \text{(Equ. 1)}$$

(2) Pressure (or head) H is proportional to the square of the shaft speed N:

$$\frac{H_1}{H_2} = \left(\frac{N_1}{N_2}\right)^2 \quad \text{(Equ. 2)}$$

(3) Power P is proportional to the cube of the shaft speed:

$$\frac{P_1}{P_2} = \left(\frac{N_1}{N_2}\right)^3 \quad \text{(Equ. 3)}$$

where:

Q is the volumetric flow rate (e.g., CFM or GPM),

N is the shaft rotational speed (e.g., rpm),

H is the pressure or head developed by the pump or other centrifugal device, and P is the shaft power.

To see how torque T affects these values, it is known that power P may be expanded as follows (using units of horsepower (hp), pound-foot, and rotations per minute (rpm), by way of example):

$$P(hp) \approx \frac{T(\text{pound} - \text{foot}) \times N(\text{rpm})}{5252} \quad \text{(Equ. 4)}$$

It is further known that torque produced by a pump and drive current to the pump are also generally linearly related, at least within a normal operating range of a pump or other centrifugal device. Based on this, if the shaft speed N is allowed to vary freely, a known amount of drive current may be provided to the pump, which will naturally attain a value of the rotational shaft speed N that corresponds to the drive current and the present load conditions as seen by the pump. In fact, shaft speed N may be expected to automatically resolve to the most natural and efficient speed for the cu conditions, without the need for actively controlling N. Thus, rather than actively modifying shaft speed N to control pump power P, the torque (via driven current) may be actively modified to control pump power P. In other variations, flow Q, head H, and/or other characteristics may be actively controlled while allowing N to naturally reach the appropriate speed.

Moreover, if one knows the range of the variable to be controlled (as may be reported by, e.g., a transducer in the system being controlled), then the variable may be controlled based on a normalized linear range, such as a percentage range. It therefore may be desirable to use a pump matched closest by current draw to the system controller, as this may provide a relatively large number of available points of control resolution. At low shaft speeds, and at speed above the pump's base speed, current may not necessarily be proportional to torque. However, in the range that pumps and other centrifugal devices normally operate, it may be safely assumed that current and torque, by percentage, are equal. It may also be desirable to look for electrical limits, these including pump motor stall on the low end and motor electrical overload on the high end. One therefore may want to set a minimum torque limit to prevent motor stall, and a maximum limit to prevent the motor from achieving overload. Once this is done, we now may have a percentage (or other scale) of usability from stall to overload expressed as a percentage (or other scale) of drive torque. If one knows the available drive torque, then calculating the actual ft/lbs from a percentage is easy.

Thus, while we may not know the actual ft/lbs produced by a pump, we may know what percentage of available torque of a given pump we are using. For example, suppose a system has two pumps (pump A and pump B) sharing a common header that is intended to hold a specific pressure of 10 PSI. Assume, in this example, that only pressure is being measured (however, in other examples, one or more other variables may additionally or alternatively be measured). Suppose it is known that, in the system, pump A uses 70% of its maximum rated power to achieve 10 PSI and 40% of its maximum rated power o achieve 5 PSI. Suppose it is further known that, in the system, pump B uses 60% of its maximum rated power to achieve 10 PSI and 30% of its maximum rated power to achieve 5 PSI. These values may be determined from a combination of rated power characteristics and system testing. Also, based on system testing, we can determine that at, e.g., 4 mA of drive current, pump A will be at the 40% power level and pump B will be at the 30% power level. We can also determine that at, e.g., 20 mA of drive current, pump A will be at the 70% power level and pump B will be at the 60% power level.

This is a simplified example, as it may turn out that pump A and pump B do not necessarily utilize the same drive current range. However, in this example, pumps A and B may be controlled by a drive current signal in which the percentage (or other measurement) of power generally linearly corresponds to the amount of drive current provided to the pumps. Thus, we have effectively created two "virtual" pump systems haying a linear performance, scaled on a common signal. Physically, both pumps may need to be run at different speeds and power consumptions, and may actually vary along non-linear curves in order to meet "virtual." minimum power, maximum power, and any desired amount of power in between. This may allow the control system to overcome potentially unpredictable centrifugal curves, non-linear dynamic resistance differences in pump and motor wear, thereby potentially allowing the control system to provide a signal that produces a linear, balanced result.

If the system curve is all the way to the right, then there is virtually no pressure and almost all of P is used by Q. Conversely, at shut off on the left side of the performance curve, almost all of P is used by H. Because Q is directly proportional to N, and H is proportional to the square of N, then changing N to affect H and Q produces a non-linear curve.

However, if torque T (or its equivalent current) is instead used as the direct control factor, then we may have also set limits to make sure that the pump motor or mechanical parts thereof (such as shafts) are never operated outside of their operating ranges. On the right side of the curve, where there is a limit on T, then N will decrease so that Q can use all of the available P, and no more. On the left side of the curve where V has little or no influence, N can go much higher than normal speed and allow H to use all of the available P safely, thereby providing the power needed to increase the performance on both sides of the curve while always inherently solving for N, which becomes non-linear.

In other words, this means that when using shaft speed N as the controlling factor, the H/Q performance curve is non-linear. When using T (of P), then the H/Q performance curve is linear, and N (which is non-linear) may be allowed to range wherever it needs to be is "solved" for at each new variation of H or Q (for example).

Besides the fact that preventing N from being anywhere that would cause overload or shaft stress may extend pump life, having a linear performance curve may potentially solve the problem of excessive proportional-integral-derivative (PID) hunting. This may be because the result of the PID equation (which is linear), may now be applied to a linear performance curve. Thus, the PID response function may be relatively more accurate and fast. There may no longer be a need to extend acceleration/deceleration times to mask PID error (as in conventional systems) that would occur if the PID loop directly controlled shaft speed N.

Moreover, allowing N to freely resolve may allow one to use the largest (most efficient) impeller in a pump to thereby potentially increase pump efficiency. Another potential advantage is being able to used recessed impeller (or vortex) pumps over a wide range of system curves that may not have been previously possible using speed N as the control factor. In contrast, in example systems described herein, at each new variation of power P, flow Q, and/or head H, speed N may be freely allowed to automatically assume a correct value.

As will be discussed below with respect to various example embodiments, a drive controller may be configured to directly control torque T (e.g., via drive current) rather than by directly controlling speed N. Where a drive controller is pre-existing, such a drive controller may, in some cases, be reconfigured to operate in this manner simply by ay of a software upgrade.

An example block representation of a drive controller system is shown in FIG. 1. The system may include one or more drive controllers 101, as well as a system under control 150. In this example, two drive controllers 101A and 101B are used, however any number may be used. When referring to a drawing element herein, a reference to the number without the corresponding letter (e.g., 101 versus 101A and 101B) is intended to refer to each of the corresponding elements. Thus, a reference to drive controllers 101 refers in this example to both drive controllers 101A and 101B.

Each of the drive controllers 101 may be or otherwise include an adjustable speed drive (ASD) and be at least partially embodied by a computer. Any or all of the elements as shown in FIG. 1 may be combined together in a single housing for each of the drive controllers 101, and some or all of those elements for a given one of the controllers 101 may communicate with each other via, e.g., an internal common high-speed bus. A computer may include any electronic, electro-optical, and/or mechanical device, or system of multiple physically separate such devices, that is able to process and manipulate information, such as in the form of data. Non-limiting examples of a computer include one or more personal computers (e.g., desktop, tablet, or laptop), servers, etc., and/or a system of these in any combination or subcombination. The physical form of the computer may be small or large. In addition, a given computer may be physically located completely in one location or may be distributed amongst a plurality of locations (i.e., may implement distributive computing). A computer may be or include a general-purpose computer and/or a dedicated computer configured to perform only certain limited functions, such as a network router.

In the present example, each drive controller 101 may be or otherwise include a variable-speed drive controller, and may include hardware that may execute software to perform specific functions. The software, if any, may be stored on a tangible non-transitory computer-readable medium (storage 106) in the form of computer-readable instructions. Each drive controller 101 (via processor 105) may read those computer-readable instructions, and in response perform various steps as defined by those computer-readable instructions. Thus, any functions and operations attributed to either of the drive controllers 101 may be partially or fully implemented, for example, by reading and executing such computer-readable instructions for performing those functions. Additionally or alternatively, any of the above-mentioned functions and operations may be implemented by the hardware of each drive controller 101, with or without the execution of any software.

Storage 106 may include, e.g., a single physical non-transitory computer-readable medium or single type of such medium, or a combination of one or more such media and/or types of such media. Examples of storage 106 include, but are not limited to, one or more memories, hard drives, optical discs (such as CDs or DVDs), magnetic discs, and magnetic tape drives. Storage 106 may be physically part of, or otherwise accessible by, the respective drive controller 101, and may store computer-readable data representing computer-executable instructions (e.g., software) and/or non-executable data.

Each drive controller 101 may also include a user input/output interface for receiving input from a user via a user input and/or providing output o the user via a user output device. Examples of user input devices may include a dial 102 (such as a physical or virtual knob that may be turned by the and a keypad 103 (together or separately sometimes referred to herein as an electronic operator interface, or EOI). An example of a user output device may include a display 104. Display 104 may also act as a user input device such as where display 104 includes a touch-sensitive screen. Display 104 may be any device capable of presenting information for visual consumption by a human, such as a television, a computer monitor or display, a touch-sensitive display, or a projector.

Each drive controller 101 further be configured to communicate with external devices and/or signals. For example, each drive controller 101 may have one or more outputs provided by a driver 107 for controlling drive current and/or other drive characteristics of a device that is part of the system under control 150. In the present example, the devices being controlled by the drive controllers 101 include two pumps that are part of the system under control 150: pump A and pump B. However, only a single pump, or more than two pumps may be used in the system. Each drive controller 101 may further have one or more inputs for receiving one or more external control signals. Each drive controller 101 may further have one or more inputs for receiving feedback signals from a transducer 110 or other feedback signal generating device of the system under control 150. In this example, the input for receiving transducer feedback is sometimes referred to herein as "VI." The VI input may be configurable to interpret either a voltage modulated signal or a current modulated signal, as desired. The transducer 110 measure, for example, the actual flow Q, head H pressure, temperature, and/or any other characteristics of the system under control 150. Each drive controller 101 may control a respective one of the pumps (e.g., pumps A and B) and/or other external devices in response to the external control signal, user input such as via dial 102 and/or keypad 103, feedback signal(s), and/or internal control decision-making algorithm(s).

Each driver 107 may output a drive current to the respective one of the pumps (pumps A and B in this example) so as to cause the pump to operate at a particular performance level. In some embodiments, the drive current generated by each driver 107 (as controlled by the respective processor 105) may be in the form of pulse-width-modulated (PWM) multi-phase (e.g., three-phase) current, where the drive current may be characterized by both a current amount (e.g., in milliamperes) and a drive frequency (e.g., the frequency of rotation of the drive signal through the set of phases). The frequency and/or quantity of drive current provided to each pump thus may be controlled by each respective drive controller 101. Moreover, each drive controller 101 may implement a current limiter function configured to prevent the amount of drive current to a given pump from exceeding a predetermined drive current limit. As will be seen from examples described later in this document, each of the pumps may be controlled by controlling the drive current limit assigned to the respective pump, while the frequency of the drive current may be otherwise allowed to run freely upward within the limits of the current limit and a maximum frequency threshold that may be imposed by processor 105.

Where one or both of the drive controllers 101 is used without an external control system and responds to transducer 110 providing a feedback signal to each drive controller 101, then the linear effect of load balancing may allow each drive controller 101 to easily find the maximum, minimum, and set points fairly simply. Via display 104, keypad 103, and/or dial 102, the user may be guided through scaling the transducer(s) to the desired units (e.g., PSI, K/cm2, bar, etc.) for each drive controller/pump pair. The user may be asked (via display 104) to enter the minimum, maximum, and set values in the appropriate unites manually. The user may then be provided a safety warning, and then the drive 101 being set may start the pump(s) at a controlled acceleration rate. The pump may be first started at a default minimum power (referred to herein as set_min) value and then increased (the amount of current being driven to the pump at any given time being stored in a value referred to herein as lb_value_out) until the scaled value of the transducer equals the scaled user setting for minimum pressure (or flow, or fluid level, or temperature, etc., or some other characteristic of the system under control 150 being monitored by the transducer 110). If there is an overshoot, the drive controller 101 may reduce the control signal to the pump as needed. Once the actual pressure (or other characteristic being monitored) equals the minimum setting value (set_min), then the amount of drive current currently being sent to the pump may be written to a value referred to herein as lb_set_min in, e.g., an electrically erasable programmable read-only memory (EEPROM) of storage 106. This procedure may then be repeated for the maximum (set_max) in the same manner as for the minimum. In alternative embodiments, the maximum may be set before the minimum.

After this is accomplished for each drive controller 101 the system may be ready for use with an internal PID routine (executed by each drive controller 101) if desired. For each of the drive controllers 101, the stored load value that equaled the set point may be sent to lb_value_out as soon as the pump speed (referred to herein as Hz) passes the low speed boost point. If the system curve has not drastically changed, then the pressure (or other characteristic being monitored) may be expected to immediately go to or near the set point before the PID routine (if used) even begins. This may be desirable because, in such a case, the PID routine may be expected to begin with virtually no error. In other words, the user may expect to see the desired set point being implemented nearly immediately after the pump is begun to be operated.

Where one or both of the drive controllers 101 is controlled by an external system such as a PLC automation system, manual tuning may be desirable. While in either of the set minimum or set maximum procedures described above, the acceleration and/or deceleration rate of the pump may be extended. This a may be desirable because, in order to meet a specific measured characteristics (e.g., pressure, flow, etc.) from a gauge, any changed in lb_value_out may need to be adequately smoothed by a longer acceleration/deceleration time in order to accurately dial in the pressure (or flow, etc.). Also, in some systems such as large pressure water systems, any violent changes in pressure may cause damage to piping and/or otherwise shorten the life expectancy of the system. Once the pump is running under control, the acceleration/deceleration time may be shortened for the load balancing routine.

One of the manual set procedures that may be used is, before starting, to determine the electrical maximum to be sent to the pump motor. The formula to be used may be, e.g.,: the ratio of motor full load (FLA) amps/maximum rated driver 107A or 107B output amps. The resulting value of this ratio may be the maximum value that lb_max_set, which will be discussed further below, may attain. Where the drive output current amount can be read internally by drive controller 101, the user may only need to enter the motor full load amps (FLA), and the resulting value may be written to lb_max_value before event starting the above-discussed tuning procedure. As an example, the motor may have an FLA rating of 1.2 and the maximum output amperage of driver 107 of drive controller 101 may be 3.3 amps. In this ease, an lb_max_yalue of 36 would be 1.2 amps or 100% of the motor rating. Drive controller 101 may ask the user to input the motor FLA, read the drive's output amps, divide those, and write the answer to lb_max_value in the above-mentioned EEPROM. Now, when in tuning mode (either manual or automatic), the motor should not become overloaded, which would otherwise potentially cause mechanical damage during the set maximum tuning procedure.

Figure 2:
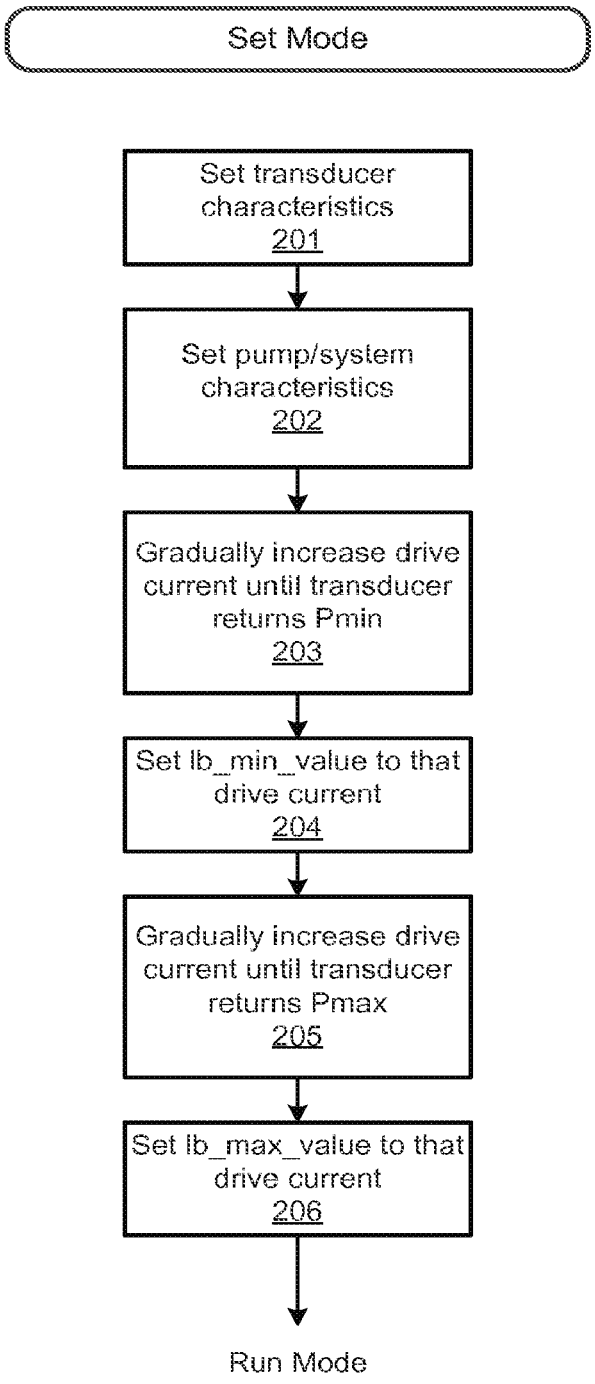
FIG. 2 is a flow chart showing example steps that may be performed during a set mode of a drive controller, in accordance with one or more aspects as described herein.

FIG. 2 is a flow chart showing example steps that may be performed during a set mode of each of the drive controllers 101, in accordance with one or more aspects as described herein. Any of the steps may be at least partially performed and/or controlled by the respective drive controller 101, particularly such as by processor 105. The set mode may allow the respective drive controller 101 to tune itself to the transducer and pump connected thereto. The user may repeat the procedure of FIG. 2 for each drive controller being used.

At step 201, the user may enter one or more characteristics of the transducer 110 and of the system under control 150. For example, the user may enter, using keypad 103 and/or dial 102, the units, output signal range, and/or sensing range of the transducer 110. The user may further enter the range of the variable to be controlled that will be allowed to operate in the system under control 150, the range having lower and upper endpoints referred to herein as range of lb_scale_in_min to lb_scale_in_max, respectively. For example, where pressure in the system under control 150 is the variable being controlled, then the user may enter a minimum pressure (Pmin) and a maximum pressure (Pmax). The user may also enter a set point of the variable being controlled. For example, it may be desired that the pressure in the system under control 150 (as measured by the transducer 110) is initially set to a set point (Pset) when first operated.

Next at step 202, one or more characteristics of the pump may be entered, such as by using keypad 103 and/or dial 102. For example, the user may enter, using keypad 103 and/or dial 102, the maximum rated current (FLA) of the pump.

Next, at steps 203-206, the drive controller 101 may operate the pumps in the system under control 150, while reading feedback from the transducer 110, so as to determine how much drive current is needed to drive the pump to reach the minimum, maximum, and/or set point of the variable to be controlled (e.g., Pmin, Pmax, and/or Pset). At step 203, a warning may be displayed to the user (e.g., on display 104) that the pump will begin to operate, and the respective pump (e.g., pump A) may be started up by gradually increasing the drive current from the driver 107 to the pump. While this is occurring, the drive frequency may be allowed to freely run as fast as it can for le drive current presently being provided to the pump. When the transducer 110 returns a s representing Pmin, then the drive controller 110 will know that this means that the amount of drive current presently being provided to the pump corresponds to the Pmin value. Thus, the drive controller 110 may store this drive current amount. In the present example, at step 204, a value representing the amount of drive current may be stored in a storage location called lb_min_value.

At step 204, the drive current the respective pump may then continue to gradually increase. Again, while this is occurring, the drive frequency may still be allowed to freely run as fast as it can for the drive current presently being provided to the pump. When the transducer 110 returns a signal representing Pmax, then the drive controller 110 will know that this means that the amount of drive current presently being provided to the pump corresponds to the Pmax value. Thus, the drive controller 110 may store this drive current amount. In the present example, at step 206, a value representing the amount of drive current may be stored in a storage location called lb_max_value.

The process may also involve performing the same steps as steps 205 and 206 for the Pset value, if desired. Also, while the process of FIG. 2 shows lb_min_value being determined prior to lb_max_value, these values may be determined in an opposite order (e.g., by performing steps 205 and 206 prior to steps 203 and 204).

In any case, the drive controller 101 now knows a correspondence between Pmin and lb_min_value and between Pmax and lb_max_value (and possibly also betting Pset and the amount of corresponding drive current). As discussed above, where the drive frequency is not being actively controlled, it may be expected that the relationship between pressure (or another variable being controlled) should be generally linear with regard to current. Thus, the drive controller 101 now has sufficient information to linearly interpolate and scale any desired value of pressure (or other variable being controlled) to a corresponding amount of drive current.

Once each drive controller 101 has been set, each drive controller 101 may be placed into run mode, meaning that the respective pumps may be controlled to operate to maintain a particular set point of the variable to be controlled (e.g., pressure, flow, temperature, fluid level, etc.). The set point may be the set point established during the set mode, or it may be another set point established at the beginning of run mode or at any time during run mode. An example of how run mode may operate for each of the drive controllers 101 is shown in FIG. 3.

Figure 3:
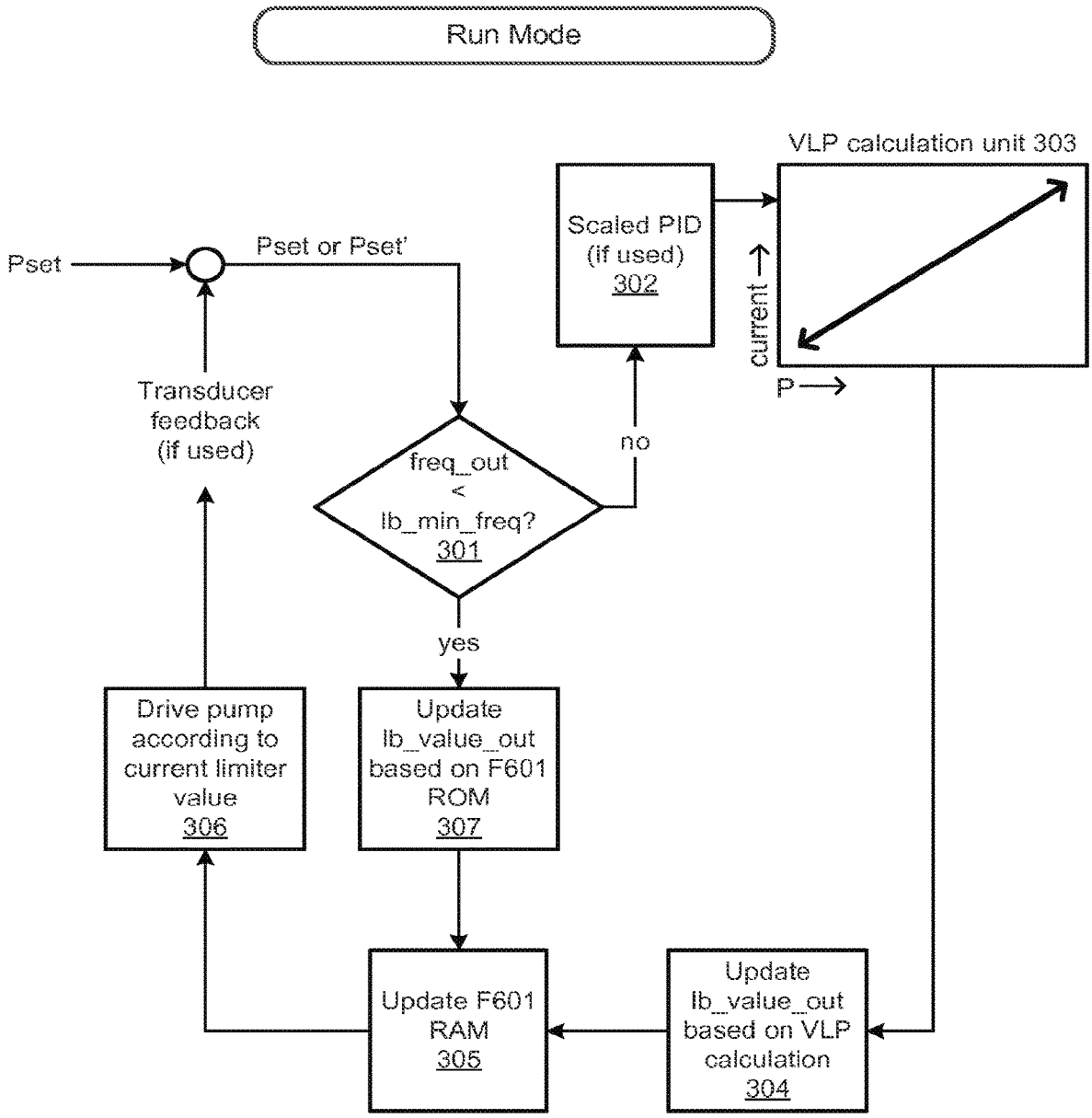
FIG. 3 is a flow chart showing example steps that may be performed during a run mode of a drive controller, in accordance with one or more aspects as described herein.

In the example run node of FIG. 3, the drive controller 101 may receive or otherwise determine a set point of the variable to be controlled. In this example, it will be assumed that the set point is a set pressure Pset, will be between Pmin and Pmax. The drive controller may operate in two types of run mode, which may be selectable by the user such as via the keypad 103 and/or the dial 102: an automatic PID mode using transducer feedback, or a direct control mode. In the direct control mode, the Pset signal is used to determine the appropriate amount of drive current being provided by the driver 107 to the pump. In the automatic PID mode, the drive, current generated by driver 107 is based on both Pset and feedback from the transducer 110.

If the drive controller 101 is in direct control mode, then Pset is fed directly to a virtual linear pump (VLP) calculation unit 303. VLP calculation unit 303 may be implemented as software and/or hardware, and may convert the input Pset to a corresponding amount of drive current using scaled linear interpolation. As explained previously, the scaled linear interpolation may be accomplished based on the Pmin, Pmax, lb_min_value and lb_max_value established during the set mode, and based on the assumption that the relationship between P and the drive current is linear. The relationship may be in any units desired, including percentage within the range of Pmin to Pmax versus the percentage within the range of lb_min_value and lb_max_value (or the percentage within the range of 0 to the maximum amount of current that the driver 107 can generate).

On the other hand, if the driver controller 101 is in automatic PID mode, then the set point Pset and the feedback signal from the transducer 110 may be combined (e.g., compared) to produce a signal Pset'. Pset' may therefore depend upon an error that s the difference between Pset and the actual P as measured and reported by the transducer 110. In this mode, then Pset' (or Pset and the transducer feedback) may be provided to a scaled PID function 301 (which may be operated by software and/or hardware). The output of the PID function 301 may then be fed into VLP calculation unit 303. Because of the linear relationship between the commanded Pset and the drive current, it may, be expected that PID function 301 may not need to make significant adjustments once the control has stabilized, as compared with conventional PID-based control systems.

In either mode, VLP calculation unit 303 may determine the amount of drive current based on the input pressure value (or based on whatever variable is being controlled) using scaled linear interpolation as discussed previously. At step 304, the drive current amount determined by VLP calculation unit 303 (which may be in any units, including percentage) may be stored, such as in a storage location of storage 106 named, e.g., lb_value_out. At step 305, the value stored in lb_value_out may be transferred to RAM location F601. In the present example, driver 107 is configured to produce whatever amount of current is indicated by the value presently store in RAM location F601. Thus, in the present example, simply updating the value in RAM F601 will cause the drive current to adjust the drive current limiter according to that value. Because the rotational frequency of the drive current is based to increase as much as possible without exceeding the drive current limiter value, this may cause the rotational frequency of the pump to naturally attain an efficient speed for the pumping conditions. If the pump speed begins to cause the drive current to exceed the current limiter value, then the speed is automatically decreased until the current limiter value is reached. If the speed is not sufficient to cause the drive current to meet the current limiter value, then the speed is increased until it does. At step 306, the pump receives the drive current.

The cycle in FIG. 3 may be repeated in an endless loop. For example, the loop may be traversed (and thus the RAM F601 value updated) many times per second, such as about every 200 milliseconds, or even faster. Since the control functions of FIG. 3 may all be physically located within the drive controller 101 itself, the driver controller 101 to repeat the process of FIG. 3 at a relatively high frequency.

Also, in either the direct control mode or the automatic PID mode, there may be a concern that the pump may not receive sufficient drive current in a startup and/or shutdown condition. Therefore, it may be desirable to include a step 301 in which it is determined whether the rotational speed of the drive current this case, referred to as freq_out) is less than a predetermined minimum threshold frequency (in this case referred to as lb_min_freq). The value of lb_min_freq may correspond to a relatively low rotational speed, as desired, such as 15 Hz. If the determination is false, then the process operates as discussed above. If the determination is true, then rather than storing the value determined by VLP calculation unit 303 in lb_value_out, the drive controller 101 may store a predetermined value in lb_value_out that is sufficiently high to ensure enough drive current is provided to the pump while the frequency is low. In the present example, the predetermined value may be stored in location F601 of the EEPROM, however it may be stored in any way desired. In some embodiments, F601 may be set at a value that is at or above the maximum possible current that can be driven by driver 107, such as about 110% of the maximum current. Thus, if the outcome of step 301 is true, then at step 307 lb_value_out may be set to the value of EEPROM F601 (the predetermined default current value), and at step 305, this value may be updated to the RAM F601.

Figure 4:
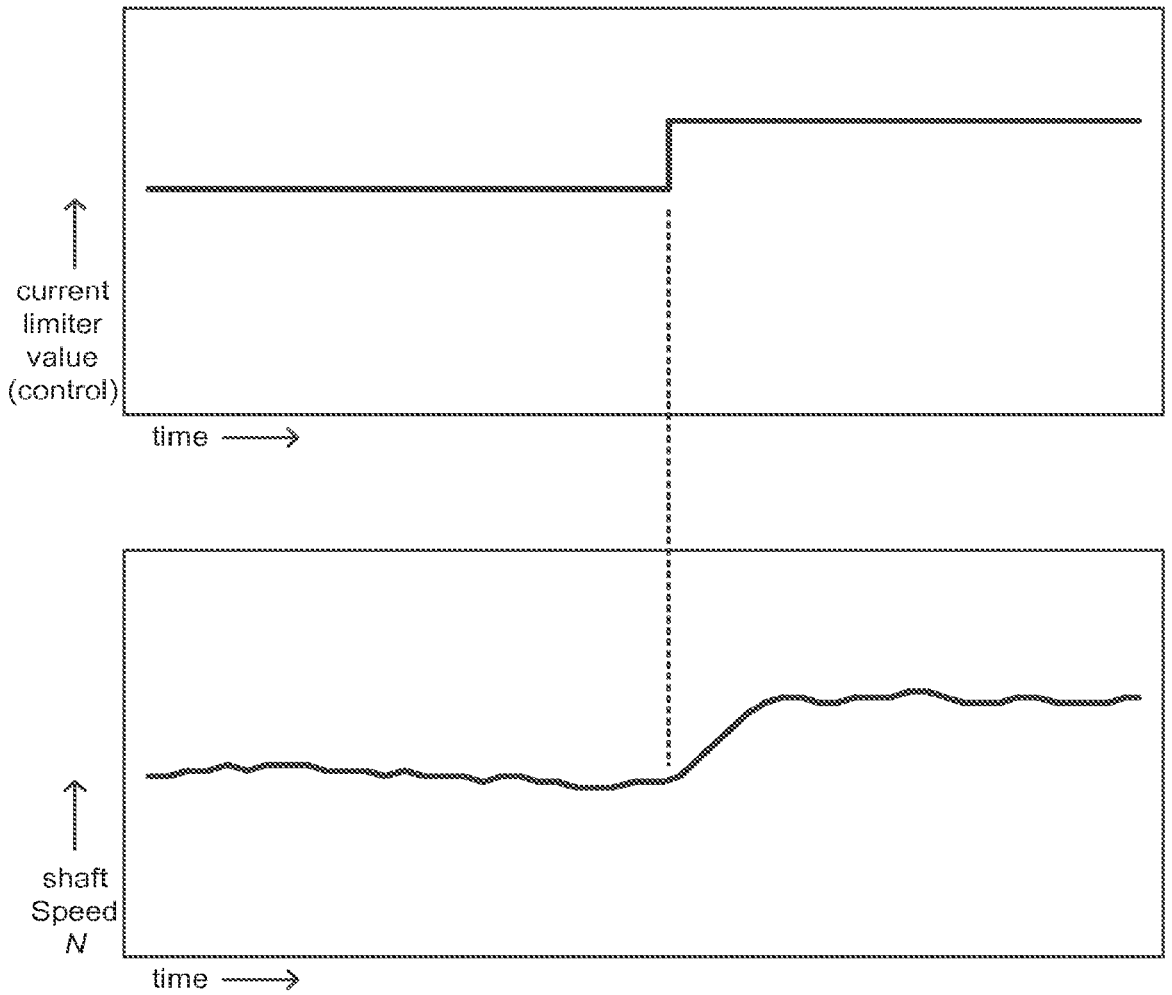
FIG. 4 is a pair of graphs showing an example of current limit control with a resulting possible free pump shaft speed response.

FIG. 4 contains a pair of graphs showing an example of current limit control with a resulting possible free pump shaft speed response. The top graph shows the current limiter value in RAM F601 over time, and the bottom graph shows the shaft speed of the pump being controlled over the same window of time. It can be seen that the shaft speed may vary over time even though the current limiter value remains constant. It also can be seen that, while the current limiter value may have an effect on the shaft speed, the shaft speed may also be affected by other factors, such as pump conditions in the system under control 150. In this example, the drive controller may be able to operate in at least two modes: a speed control mode and a load balancing mode. In the speed control mode, the speed and/or torque may be directly controlled, such as by an external control signal and/or by user input (such as via dial 102). The speed control mode may therefore operate in a conventional manner. In the load balancing mode, rather than directly controlling speed, the drive controller may automatically provide the appropriate drive current to each of a plurality of pumps to balance their loads as desired. For instance, in a manner as discussed above, the load balancer mode may allow for the drive controller to exercise precise linear control of pumps and other devices that follow centrifugal law. In this mode, one may be able to provide, for example, a set point of specific mass-at-flow for the upper and lower limits of the performance desired, and have all points in between represent a scaled performance as a percentage of the incoming control signal. This may potentially allow multiple devices in a system that have different electrical and mechanical characteristics to evenly share the load on the system. Each device in the system may need to run at different speeds and current draws in order to achieve this balancing according to their own unique characteristics.

The following includes a list of example functions, variables, retentive data, input/output signals, and process flow descriptions for this example. Any of the functionality described below may be implemented at least in part by, e.g., processor 105, such as by executing computer-executable instructions. Any data and executable instructions may be stored in, e.g., storage 106. The names, values, ranges, and defaults described herein are merely examples and are not intended to be considered limiting.

The linear interpolation scaling of FIG. 3 may be implemented according to the following calculations, for example:

$$\frac{y-y_1}{x-x_1}=\frac{y_2-y_1}{x_2-x_1}=\frac{y_2-y}{x_2-x},$$

where the equation of the linear VLP relationship between the variable to be controlled and drive current may be:

$$\frac{y-y_1}{x-x_1}=\frac{y_2-y_1}{x_2-x_1}.$$

Or:

$$y-y_1=\frac{y_2-y_1}{x_2-x_1}(x-x_1),$$

$$y=\frac{y_2-y_1}{x_2-x_1}(x-x_1)+y_1, \text{ and}$$

$$y=\frac{y_2-y_1}{x_2-x_1}x-\frac{y_2-y_1}{x_2-x_1}x_1+y_1.$$

In the above equations, when the PID function is ON (the drive controller 101 is running in automatic PID mode), then, for example:

$$x_1 = \text{1b_scale_in_min and } x_2 = \text{1b_scale_in_max, and}$$

$$y_1 = \text{1b_min_value and } y_2 = \text{1b_max_value.}$$

And, when the PID function is off (the drive controller 101 is running in direct control mode), then, for example:

$$x_1 = VI \text{ or } EOI \text{ 1b_scale_in_min and}$$

$$x_2 = VI \text{ or } EOI \text{ 1b_scale_in_max, and}$$

$$y_1 = \text{1b_min_value and } y_2 = \text{1b_max_value.}$$

When both drive controllers 101A and 101B are running in automatic PID mode, then one potential advantage of the example system described herein is that the two drive controllers 101 may automatically achieve load balancing between pumps A and B, even though the two driver controllers 101 may not necessarily communicate with each other. This is because each of the drive controllers 101 may be individually set (via, e.g., the process of FIG. 2) to operate its respective pump, and may individually automatically control its own set point. As already explained, by controlling the drive current rather than the pump speed directly, each pump may naturally attain the correct, and potentially most efficient, speed for the present operating conditions. Thus, even though each drive controller may act independently and without knowledge of the operation of the other drive controller(s) in a system, the drive controllers may achieve load balancing of the system because they would each cause their respective pumps to operate in a demand-based manner. This may be advantageous because the load balancing functionality of the system may not necessarily depend upon an interconnection between the various drive controllers, and so would not be prone to failure of such an interconnection preventing load balancing from being achieved.

However, in some cases it may be desirable to coordinate operation between the two drive controllers 101A and 101B. For example, it may be desirable to ensure that both drive controllers 101A and 101B start and/or stop in a coordinated manner (e.g., simultaneously or sequentially). In such a case, one or both of the drive controllers 101 may start, stop, adjust the commanded pressure (or other variable being controlled), and/or otherwise adjust drive current responsive to an external control signal. The external control signal may be generated by a source external to both of the drive controllers 101, or it may be generated by one of the drive controllers 101 and fed to the other of the drive controllers 101. For example, it may be desirable that, if one of the drive controllers 101 suddenly stops operating (e.g., a fault condition in the pump is detected), it may be desirable that that drive controller 101 send a stop signal to the other drive controller 101, which in response would also stop operating (or vice versa).

Another situation in which it may be desirable to communicate between the drive controllers 101 may be to cause additional (or fewer) drive controllers to operate depending upon operating conditions. For example, one of the drive controllers (e.g., 101A) may be configured to be the primary drive controller, and the other be configured to be the secondary drive controller. In such a configuration, the primary drive controller may operate while the secondary is in standby. If the primary drive controller determines that it has been continuously operating at Pmax for at least a threshold amount of time (e.g., five seconds, or one minute, or any other amount of time), then the primary drive controller may automatically send a signal to the secondary dove controller (e.g., by closing a relay controlling the secondary drive controller). In response, the secondary drive controller may start up and attain its set point. Conventional multi-pump systems take pumps on and off standby when the variable to be controlled is unable to achieve its commanded value. For example, in conventional systems, if the pressure as measured by the transducer cannot reach its commanded value, then such systems may activate an additional pump. Thus, a conventional system may need to see the pressure drop before responding by starting up an additional pump. However, because aspects of the present configuration are demand-based, the present system may be able to detect that the demand is exceeding the capability before the pressure drops, and respond accordingly by turning on another pump.

While various embodiments have been illustrated and described, it is not intended that these embodiments illustrate and describe all possible forms of the present invention. Rather, the words used in the specification are words of description rather than limitation, and it is understood that various changes may be made without departing from the spirit and scope of the present disclosure.

For example, while certain values, storage location names, and variable names are used herein, these are merely by way of example, and alternate values, storage locations, and variable names may be used. Also, while many of the examples herein refer to the transducer 110 measuring pressure in the system under control 150, any other variable to be controlled may be measured and reported. For instance, the transducer 110 (or other measurement device) may measure and report fluid temperature, fluid level, fluid flow, and/or mass at flow. Moreover, the fluid being transported may be liquid, gas, plasma, or any combination thereof, and may even include loose solids as well. And, while many of the examples herein refer to driving a pump, any fluid transport device may be controlled using the techniques described herein, including but not limited to electrically-driven centrifugal devices such as centrifugal pumps and centrifugal fans; and other centrifugal or non-centrifugal pumps and fans such as bilge pumps, disc flow pumps, grinder pumps, mixed-flow impeller pumps, recessed impeller pumps, slurry pumps, vertical multi-stage pumps, vertical turbine pumps, and/or water pumps. It is foreseen that the techniques described herein may be applicable to a number of industries, such as but not limited to chemical, city municipality, coal mine, food, industrial irrigation, paper, petroleum, power plant, and water/wastewater.

The invention claimed is:

1. A method comprising:

determining a first relationship between drive current for a first centrifugal device and a physical characteristic associated with a system, wherein the system comprises the first centrifugal device and a second centrifugal device;

sending, via a first driver and to the first centrifugal device, a first amount of drive current that is based on a first set point value of the physical characteristic and based on the first relationship; and causing, based on the first amount of drive current satisfying a criterion, a second driver to drive the second centrifugal device.

2. The method of claim 1, wherein the criterion comprises the first amount of drive current being at least a threshold amount of drive current for at least a threshold amount of time.

3. The method of claim 1, further comprising:

determining a second relationship between the physical characteristic and drive current for the second centrifugal device; and sending, via the second driver and to the second centrifugal device, a second amount of drive current that is based on a second set point value of the physical characteristic and based on the second relationship.

4. The method of claim 1, wherein the causing the second driver to drive the second centrifugal device comprises causing the second driver to start up the second centrifugal device from a standby state.

5. The method of claim 1, wherein the physical characteristic comprises at least one of: a fluid flow, a fluid pressure, a temperature, or a fluid level.

6. The method of claim 1, wherein the determining the first relationship comprises:

sending, by the first driver, a plurality of amounts of drive current to the first centrifugal device, wherein for each of the plurality of amounts of drive current, the first centrifugal device attains a highest speed without exceeding a respective one of the plurality of amounts of drive current; and determining the first relationship based on measurements of the physical characteristic taken while the plurality of amounts of drive current are sent to the first centrifugal device.

7. The method of claim 6, wherein the plurality of amounts of drive current comprises a second amount of drive current associated with a minimum value of the physical characteristic and a third amount of drive current associated with a maximum value of the physical characteristic, the method further comprising:

determining, based on the second amount of drive current and the third amount of drive current, the first amount of drive current.

8. An apparatus comprising:

a first driver;

a first processor; and a first computer-readable medium storing instructions that, when executed by the first processor, cause the apparatus to:

determine a first relationship between drive current for a first centrifugal device and a physical characteristic associated with a system, wherein the system comprises the first centrifugal device and a second centrifugal device;

send, via the first driver and to the first centrifugal device, a first amount of drive current that is based on a first set point value of the physical characteristic and based on the first relationship; and cause, based on the first amount of drive current satisfying a criterion, a second driver to drive the second centrifugal device.

9. The apparatus of claim 8, wherein the criterion comprises the first amount of drive current being at least a threshold amount of drive current for at least a threshold amount of time.

10. The apparatus of claim 8, further comprising:

the second driver;

a second processor; and a second computer-readable medium storing instructions that, when executed by the second processor, cause the apparatus to:

determine a second relationship between the physical characteristic and drive current for the second centrifugal device; and send, via the second driver and to the second centrifugal device, a second amount of drive current that is based on a second set point value of the physical characteristic and based on the second relationship.

11. The apparatus of claim 8, wherein the instructions, when executed by the first processor, cause the apparatus to cause the second driver to drive the second centrifugal device comprises by at least starting up the second centrifugal device from a standby state.

12. The apparatus of claim 8, wherein the physical characteristic comprises at least one of: a fluid flow, a fluid pressure, a temperature, or a fluid level.

13. The apparatus of claim 8, wherein the instructions, when executed by the first processor, cause the apparatus to determine the first relationship by at least:

sending, by the first driver, a plurality of amounts of drive current to the first centrifugal device, wherein for each of the plurality of amounts of drive current, the first centrifugal device attains a highest speed without exceeding a respective one of the plurality of amounts of drive current; and determining the first relationship based on measurements of the physical characteristic taken while the plurality of amounts of drive current are sent to the first centrifugal device.

14. The apparatus of claim 13, wherein the plurality of amounts of drive current comprises a second amount of drive current associated with a minimum value of the physical characteristic and a third amount of drive current associated with a maximum value of the physical characteristic, and wherein the instructions, when executed by the first processor, cause the apparatus to:

determine, based on the second amount of drive current and the third amount of drive current, the first amount of drive current.

15. One or more non-transitory computer-readable media storing instructions that, when executed, cause an apparatus comprising a first driver to:

determine a first relationship between drive current for a first centrifugal device and a physical characteristic associated with a system, wherein the system comprises the first centrifugal device and a second centrifugal device;

send, via the first driver and to the first centrifugal device, a first amount of drive current that is based on a first set point value of the physical characteristic and based on the first relationship; and cause, based on the first amount of drive current satisfying a criterion, a second driver to drive the second centrifugal device.

16. The one or more non-transitory computer-readable media of claim 15, wherein the criterion comprises the first amount of drive current being at least a threshold amount of drive current for at least a threshold amount of time.

17. The one or more non-transitory computer-readable media of claim 15, wherein the apparatus further comprises the second driver, and wherein the instructions, when executed, further cause the apparatus to:

determine a second relationship between the physical characteristic and drive current for the second centrifugal device; and send, via the second driver and to the second centrifugal device, a second amount of drive current that is based on a second set point value of the physical characteristic and based on the second relationship.

18. The one or more non-transitory computer-readable media of claim 15, wherein the physical characteristic comprises at least one of: a fluid flow, a fluid pressure, a temperature, or a fluid level.

19. The one or more non-transitory computer-readable media of claim 15, wherein the instructions, when executed, cause the apparatus to determine the first relationship by at least:

sending, by the first driver, a plurality of amounts of drive current to the first centrifugal device, wherein for each of the plurality of amounts of drive current, the first centrifugal device attains a highest speed without exceeding a respective one of the plurality of amounts of drive current; and determining the first relationship based on measurements of the physical characteristic taken while the plurality of amounts of drive current are sent to the first centrifugal device.

20. The one or more non-transitory computer-readable media of claim 19, wherein the plurality of amounts of drive current comprises a second amount of drive current associated with a minimum value of the physical characteristic and a third amount of drive current associated with a maximum value of the physical characteristic, and wherein the instructions, when executed, cause the apparatus to:

determine, based on the second amount of drive current and the third amount of drive current, the first amount of drive current.

* * * * *